US005699792A

United States Patent [19]

Reese et al.

[11] Patent Number: 5,699,792

[45] **Date of Patent: *Dec. 23, 1997**

[54] FACE MASK WITH ENHANCED FACIAL SEAL

[75] Inventors: George D. Reese, Arlington; Albert R. Rich, Jr., Watauga; Kevin K. Brunson, Argyle, all of Tex.

[73] Assignee: Tecnol Medical Products, Inc., Fort Worth, Tex.

[ * ] Notice: The term of this patent shall not extend beyond the expiration date of Pat. No. 5,553,608.

[21] Appl. No.: 728,040

[22] Filed: Oct. 9, 1996

Related U.S. Application Data

[63] Continuation of Ser. No. 374,321, Jan. 18, 1995, abandoned, which is a continuation-in-part of Ser. No. 278,930, Jul. 20, 1994, Pat. No. 5,553,608.

[51] Int. Cl.[6] ..... A62B 18/08; A62B 7/10; A62B 23/02; A62B 18/02

[52] U.S. Cl. ..... 128/206.19; 128/206.24; 128/206.21; 128/207.11

[58] Field of Search ..... 128/206.12, 206.13, 128/206.16, 206.17, 206.19, 206.21, 206.22, 206.24, 206.27, 207.11

[56] References Cited

U.S. PATENT DOCUMENTS

| | | | |
|---|---|---|---|
| D. 249,072 | 8/1978 | Revoir | 29/2 |
| D. 270,110 | 8/1983 | Moore et al. | D2/3 |

(List continued on next page.)

FOREIGN PATENT DOCUMENTS

| | | |
|---|---|---|
| 1085259 | 9/1980 | Canada . |
| 0355444 | 7/1989 | European Pat. Off. . |
| 391726 | 4/1990 | European Pat. Off. . |
| 0515986 | 12/1992 | European Pat. Off. . |
| 867791 | 11/1941 | France . |
| 2471792 | 6/1981 | France . |
| 655814 | 1/1938 | Germany . |
| 688227 | 2/1940 | Germany . |
| 2717968 | 12/1977 | Germany . |
| 7706660 | 12/1977 | Netherlands . |
| 4789 | of 1912 | United Kingdom . |
| 5104 | of 1913 | United Kingdom . |
| 967455 | 8/1964 | United Kingdom . |
| 1049604 | 11/1966 | United Kingdom . |
| 1433504 | 4/1976 | United Kingdom . |
| 1473924 | 5/1977 | United Kingdom . |
| 2028664 | 3/1980 | United Kingdom . |
| 1588442 | 4/1981 | United Kingdom . |
| 2072516 | 10/1981 | United Kingdom . |
| 2103491 | 2/1983 | United Kingdom . |
| WO8101019 | 11/1979 | WIPO . |
| WO8103266 | 5/1981 | WIPO . |
| 8601734 | 3/1986 | WIPO . |
| WO8900874 | 7/1988 | WIPO . |
| WO8910106 | 4/1989 | WIPO . |
| 8910106 | 11/1989 | WIPO . |

OTHER PUBLICATIONS

Annotated Figure 2 from 4,419,993.

"The Condensed Chemical Dictionary", copyright 1961, pub. by Reinhold Publishing Corp., N.Y., Sixth Ed., pp. 826, 827, 910–911.

(List continued on next page.)

*Primary Examiner*—Kimberly L. Asher

*Attorney, Agent, or Firm*—Baker & Botts, L.L.P.

[57] ABSTRACT

A face mask is provided that includes a filter body capable of filtering liquids, particles and aerosols of a size appropriate for the mask's intended purposes, while providing excellent breathability and comfort for extended periods of wear. The filter body may be formed from multiple layers of filtration material having a generally rectangular configuration with multiple pleats. The mask may be secured to the head of a wearer by ear loops or surgical tie strips attached to flaps extending from the filter body to form a fluid seal between the periphery of the mask and the wearer's face. For some applications, strips of resilient or stretchable material which further enhance both the fluid seal formed by the mask and comfort for the wearer may be attached along each side of the filter body with surgical tie strips or ear loops attached to the strips of resilient material.

22 Claims, 4 Drawing Sheets

U.S. PATENT DOCUMENTS

| | | | |
|---|---|---|---|
| D. 287,649 | 1/1987 | Zdrok et al. | D29/7 |
| D. 312,331 | 11/1990 | Poettgen | D29/8 |
| D. 319,111 | 8/1991 | Sawdel et al. | D29/9 |
| D. 326,932 | 6/1992 | Millar | D29/9 |
| D. 327,141 | 6/1992 | Hubbard et al. | D29/9 |
| 797,293 | 8/1905 | Lang et al. . | |
| 911,476 | 2/1909 | Cheesman . | |
| 1,170,052 | 2/1916 | Diener . | |
| 1,292,095 | 1/1919 | Schwartz . | |
| 1,337,036 | 4/1920 | Bergmann . | |
| 1,923,340 | 8/1933 | Steckler | 2/174 |
| 1,987,922 | 1/1935 | Blatt | 128/139 |
| 2,012,505 | 8/1935 | Goldsmith . | |
| 2,029,947 | 2/1936 | Schmitt et al. | 128/146 |
| 2,033,691 | 3/1936 | Douglass | 2/174 |
| 2,056,753 | 10/1936 | Wagner | 128/141 |
| 2,116,241 | 5/1938 | Heumann | 128/139 |
| 2,149,067 | 2/1939 | Otero | 128/139 |
| 2,176,006 | 10/1939 | Ehrlich | 2/13 |
| 2,227,667 | 1/1941 | Panettiere . | |
| 2,248,477 | 7/1941 | Lombard | 128/207.11 |
| 2,253,101 | 8/1941 | Thoreson | 2/13 |
| 2,280,055 | 4/1942 | Andersen | 2/14 |
| 2,280,482 | 4/1942 | Dreyfus | 2/14 |
| 2,296,338 | 9/1942 | Dakin | 128/145 |
| 2,462,005 | 2/1949 | Schauweker | 128/146 |
| 2,494,406 | 1/1950 | Reitano | 128/146 |
| 2,556,589 | 6/1951 | Le Duc | 128/146 |
| 2,669,717 | 2/1954 | Diggs | 2/9 |
| 2,720,477 | 10/1955 | Lancaster | 154/53.5 |
| 2,762,368 | 9/1956 | Bloomfield | 128/146 |
| 2,774,970 | 12/1956 | Du Bois | 2/0 |
| 2,891,541 | 6/1959 | Tietze | 128/141 |
| 2,916,037 | 12/1959 | Hansen | 128/284 |
| 3,049,121 | 8/1962 | Brumfield et al. | 128/146 |
| 3,170,461 | 2/1965 | Watts, Jr. | 128/146 |
| 3,220,409 | 11/1965 | Liloia et al. | 128/146 |
| 3,288,138 | 11/1966 | Sachs | 128/139 |
| 3,316,904 | 5/1967 | Wall et al. | 128/146.6 |
| 3,395,406 | 8/1968 | Smith | 2/14 |
| 3,490,447 | 1/1970 | Jackson | 128/139 |
| 3,603,315 | 9/1971 | Becker, III | 128/146.2 |
| 3,613,678 | 10/1971 | Mayhew | 128/146.2 |
| 3,620,214 | 11/1971 | Thockston | 128/146.2 |
| 3,664,335 | 5/1972 | Boucher et al. | 128/146.6 |
| 3,686,690 | 8/1972 | Webb | 2/9 |
| 3,688,768 | 9/1972 | Reimschussel et al. | 128/146.2 |
| 3,779,244 | 12/1973 | Weeks, Jr. et al. | 128/146.2 |
| 3,802,429 | 4/1974 | Bird . | |
| 3,834,384 | 9/1974 | Raines | 128/146.2 |
| 3,837,995 | 9/1974 | Floden | 161/150 |
| 3,855,048 | 12/1974 | Bagnall | 161/159 |
| 3,884,227 | 5/1975 | Lutz et al. | 128/146.2 |
| 3,888,246 | 6/1975 | Lauer | 128/146.2 |
| 3,890,966 | 6/1975 | Aspelin et al. | 128/146.2 |
| 3,929,135 | 12/1975 | Thompson | 128/287 |
| 3,932,153 | 1/1976 | Byrns | 55/511 |
| 3,953,566 | 4/1976 | Gore | 264/288 |
| 3,971,369 | 7/1976 | Aspelin et al. | 128/146.2 |
| 3,971,373 | 7/1976 | Braun | 128/146.2 |
| 3,974,829 | 8/1976 | Tate, Jr. | 128/146.2 |
| 3,985,132 | 10/1976 | Boyce et al. | 128/146.2 |
| 3,989,867 | 11/1976 | Sisson | 428/132 |
| 4,037,593 | 7/1977 | Tate, Jr. | 128/146.2 |
| 4,064,876 | 12/1977 | Mulchi | 128/146.6 |
| 4,187,390 | 2/1980 | Gore | 174/102 |
| 4,195,629 | 4/1980 | Halford | 128/206.13 |
| 4,215,682 | 8/1980 | Kubik et al. | 128/205.29 |
| 4,296,746 | 10/1981 | Mason, Jr. et al. | 128/201.15 |
| 4,300,549 | 11/1981 | Parker | 128/206.19 |
| 4,319,567 | 3/1982 | Magidson | 128/206.19 |
| 4,323,063 | 4/1982 | Fisichella | 128/139 |
| 4,382,440 | 5/1983 | Kapp et al. | 128/201.25 |
| 4,384,577 | 5/1983 | Huber et al. | 128/206.19 |
| 4,417,575 | 11/1983 | Hilton et al. | 128/206.19 |
| 4,419,993 | 12/1983 | Petersen | 128/201.15 |
| 4,419,994 | 12/1983 | Hilton | 128/206.19 |
| 4,435,852 | 3/1984 | Nesler | 2/436 |
| 4,454,881 | 6/1984 | Huber et al. | 128/206.15 |
| 4,495,030 | 1/1985 | Giglia | 128/206.19 |
| 4,510,931 | 4/1985 | Henderson et al. | 128/202.28 |
| 4,522,203 | 6/1985 | Mays | 128/132 D |
| 4,536,440 | 8/1985 | Berg | 428/284 |
| 4,547,420 | 10/1985 | Krueger et al. | 428/229 |
| 4,551,378 | 11/1985 | Carey, Jr. | 428/198 |
| 4,600,002 | 7/1986 | Maryyanek et al. | 128/206.19 |
| 4,606,341 | 8/1986 | Hubbard et al. | 128/206.19 |
| 4,610,036 | 9/1986 | LaPrairie | 2/12 |
| 4,628,927 | 12/1986 | Ward | 128/206.17 |
| 4,635,628 | 1/1987 | Hubbard et al. | 128/201.17 |
| 4,641,645 | 2/1987 | Tayebi | 128/206.19 |
| 4,646,367 | 3/1987 | El Hassen | 2/411 |
| 4,657,802 | 4/1987 | Morman | 428/152 |
| 4,662,005 | 5/1987 | Grier-Idris | 2/9 |
| 4,684,570 | 8/1987 | Malaney | 428/296 |
| 4,688,566 | 8/1987 | Boyce | 128/206.19 |
| 4,701,965 | 10/1987 | Landis | 2/428 |
| 4,750,482 | 6/1988 | Sieverding | 128/156 |
| 4,779,291 | 10/1988 | Russell | 2/439 |
| 4,796,621 | 1/1989 | Barle et al. | 128/206.23 |
| 4,797,956 | 1/1989 | Boyce | 2/431 |
| 4,802,473 | 2/1989 | Hubbard et al. | 128/206.19 |
| 4,807,619 | 2/1989 | Dyrud et al. | 128/206.16 |
| 4,821,340 | 4/1989 | Johnson | 2/9 |
| 4,825,878 | 5/1989 | Kuntz et al. | 128/857 |
| 4,850,347 | 7/1989 | Skov | 128/206.16 |
| 4,852,185 | 8/1989 | Olson | 2/9 |
| 4,852,189 | 8/1989 | Duggan | 2/452 |
| 4,856,509 | 8/1989 | Lemelson | 128/206.19 |
| 4,864,653 | 9/1989 | Landis | 2/9 |
| 4,872,465 | 10/1989 | Kuntz et al. | 128/857 |
| 4,883,052 | 11/1989 | Weiss et al. | 128/205.27 |
| 4,884,296 | 12/1989 | Nix, Jr. | 2/11 |
| 4,910,804 | 3/1990 | Lidgren | 2/209.3 |
| 4,920,576 | 5/1990 | Landis | 2/9 |
| 4,920,960 | 5/1990 | Hubbard et al. | 128/206.12 |
| 4,941,470 | 7/1990 | Hubbard et al. | 128/206.13 |
| 4,944,294 | 7/1990 | Borek, Jr. | 128/206.19 |
| 4,944,312 | 7/1990 | Smith | 128/857 |
| 4,945,574 | 8/1990 | Dagher | 2/9 |
| 4,965,887 | 10/1990 | Paoluccio et al. | 2/9 |
| 4,966,140 | 10/1990 | Herzberg | 128/206.19 |
| 4,969,457 | 11/1990 | Hubbard et al. | 128/206.12 |
| 5,003,633 | 4/1991 | Itoh | 2/9 |
| 5,012,805 | 5/1991 | Muckerheide | 128/205.28 |
| 5,020,533 | 6/1991 | Hubbard et al. | 128/206.23 |
| 5,025,506 | 6/1991 | Huang | 2/206 |
| 5,033,115 | 7/1991 | Bowling | 2/51 |
| 5,035,240 | 7/1991 | Braun et al. | 128/205.27 |
| 5,094,236 | 3/1992 | Tayebi | 128/206.12 |
| 5,107,547 | 4/1992 | Scheu | 2/206 |
| 5,113,528 | 5/1992 | Burke, Jr. et al. | 2/9 |
| 5,138,714 | 8/1992 | Smith | 2/9 |
| 5,150,703 | 9/1992 | Hubbard et al. | 128/206.12 |
| 5,303,423 | 4/1994 | Gazarra et al. . | |
| 5,368,021 | 11/1994 | Beard et al. | 128/205.12 |
| 5,406,943 | 4/1995 | Hubbard et al. | 128/206.12 |

OTHER PUBLICATIONS

Visimask Advertisement, W.M. Supplies (U.K.) Ltd., U.K.
Visimask for Medical Personnel Protection, W.M. Medical, U.K.

Photo of Mask (Visimask).
Tecnol Fluidshield Surgical Masks Featuring SplashGuard Visors Brochure, Tecnol, Inc. Nov. 1992.
The Mask Collection Tecnol brochure, AORN Journal, 1987.
Tecnol Fluid Shield Brochure, "The First Mask Specifically Designed to Resist Fluid Penetration".
Sample product, Combo–Cone, Anti–Fog Eye Shield Attached to Fluid Resistant Cone Mask, Barriers for Diseases (A Division of BFD Industries Ltd. Partnership).
Eyewear, *The Surgical Technologist*, Nov. 1992, p. 18.
Tecnol brochure, Hospital Products Division, "Disposable Face Shield".
"Digi" Sportlens System.
Op–d–op, Inc. visor shield, Materials Management, Mar. 1992.
Splash Protection from Eye Communications, Supervisor.
"Splash Mask", Incon.
Face Shield Disposable by BFW, SCM Medical, IC Products, and Eye Communications.
Med–Vue Protective Eye Wear.
"Delta Disposable Respirators" *Racal Health & Safety*, 1993 (4 pages).
R1050 AO Safety Products brochure, Dust Demon Foldable, Reusable/Disposable Respirator.
Glendale brochure, Dustbuster Comfort Plus Full Dust and Mist Protection 7/92/10M.
Tecnol Fluidshield Brochure, "The Only Masks With Loncet Breathable Film . . . Your Extra Protection from Body Fluids".
W.T. Davis, "Filtration Efficiency of Surgical Face Masks: The Need for More Meaningful Standards," *American Journal of Infection Control*, pp. 16–18.
Busse Hospital Disposables brochure, "If you think your mask is nothing like this one, better take a closer look." No date.

FACE MASK WITH ENHANCED FACIAL SEAL

RELATED PATENT APPLICATION

This application is a continuation of application Ser. No. 08/374,321, filed Jan. 18, 1995, entitled "Face Mask with Enhanced Facial Seal," by George D. Reese, Albert R. Rich, Jr. and Kevin K. Brunson, now abandoned; which is a continuation-in-part of application Ser. No. 08/278,930 filed Jul. 20, 1994, entitled "Face mask with Enhanced Seal and Method", now U.S. Pat. No. 5,553,608 issued Sep. 10, 1996.

TECHNICAL FIELD OF THE INVENTION

This invention relates in general to medical products, and in particular, but not by way of limitation, to a face mask with an enhanced seal to prevent fluids and aerosols from contacting the face of a wearer.

BACKGROUND OF THE INVENTION

Wearing protective face masks has become standard procedure for many health care and other related activities. The use of a face mask is important, for example, to lab technicians while conducting tests, to nurses during the care of patients, to physicians during surgery and other types of medical treatment, and to dentists working in a patient's mouth.

The rapid increase of infectious diseases, particularly AIDS, has made the use of such protective equipment increasingly important. The Center for Disease Control in Atlanta, Ga., has found that the AIDS virus (HIV) can be passed by contact with body fluids. Contact of AIDS contaminated body fluids with another person's source of body fluids, e.g., eyes, nose, mouth, etc., can pass the disease. Therefore, it is necessary to prevent a patient's body fluids from contacting the face of health care personnel.

During the past several years, health care personnel have become more aware of the potential hazards associated with airborne pathogens, such as the hepatitis B virus and infectious tuberculosis associated with many HIV patients. It has been found that aerosols having airborne liquid and solid particles are generated not only by the exhalation of infected patients, but also by certain procedural manipulations and processes that impart energy to microbial suspensions. Also many viral hemorrhagic fevers such as yellow fever, rift valley fever and perhaps rocky mountain spotted fever, rabies and smallpox can be transmitted through aerosols. A considerable number of studies have been made which are now beginning to identify the transmission of viruses through "non-accident" situations. Accordingly, there is an increased interest in a face mask which will form a complete fluid seal around the periphery of the mask and at the same time be easy to put on and comfortable to wear. Many face masks which are presently available allow the passage of fluids and/or aerosols between the periphery of the mask and the wearer's face.

One type of face mask is illustrated in U.S. Pat. No. 2,012,505 entitled *Mask*, issued on Aug. 27, 1935 to S. J. Goldsmith. Another type of face mask is illustrated in U.S. Pat. No. 4,319,567 entitled *Disposable Face Mask*, issued on Mar. 16, 1982 to M. Magidson. This mask is molded and has been especially configured in an effort to avoid leakage of fluid flow past the edges of the mask. Obviously, leakage cannot be tolerated when attempting to control liquids and aerosols. Typically, surgical style pleated face masks may have less than an optimal fit to prevent the passage of liquids and/or aerosols between the periphery of the mask and a wearer's face. Recent developments in surgical face masks have resulted in improved resistance to liquid penetration from the exterior of such masks. U.S. Pat. No. 4,920,960 entitled *Body Fluids Barrier Mask*, issued on May 1, 1990 to Hubbard, et al., is exemplary of improvements in such masks.

SUMMARY OF THE INVENTION

In accordance with the present invention, an improved face mask is provided to substantially reduce or eliminate the shortcomings previously associated with surgical style face masks. Both ear loops and surgical ties may be attached to the improved face mask in accordance with the teachings of the present invention.

The present invention provides a surgical style face mask which inhibits the passage of fluids between the periphery of the mask and the wearer's face while providing enhanced comfort to the wearer. The present invention may be used with standard pleated style face masks, off-the-face style masks, or molded cone style masks. For some applications, a pair of ear loops may be used to secure a mask incorporating the present invention with the head and face of the wearer. For other applications, a mask incorporating the present invention may be secured to the head and face of the wearer with either a pair of surgical tie strips or four separate surgical tie strips. Fluid impervious flaps may be included to extend the coverage area of the face mask and improve the fluid seal between the periphery of the mask and the face of the wearer. The fluid impervious flaps also allow reducing the amount of filter media associated with each face mask while maintaining the same amount of effective filtration area and breathability.

One aspect of the present invention provides a face mask having a filter body for covering the nose and mouth of a wearer. The filter body has top and bottom edges with the top edge arranged to extend across the bridge of the nose of the wearer and the bottom edge arranged to extend under the wearer's chin. Resilient strips of material may be attached to and extend along each side of the filter body for use in attaching the mask to the wearer's face and to provide an enhanced fluid seal between the periphery of the mask and the wearer's face. Surgical ties, ear loops or other suitable securing means may be attached to the respective resilient strips adjacent to each side of the filter body. The securing means may be extended over the head of the wearer for use in urging the top and bottom edges of the filter body and each side of the filter body into tight engagement with the wearer's face to prevent undesired fluid flow between the periphery of the mask and the wearer's face. The securing means may be formed from resilient material to provide comfort to the wearer while maintaining a tight peripheral seal for long periods of time. The securing means may be formed from various other types of material as desired. For one application of the present invention, a first and second securing means associated with each resilient strip may be crossed over each other to further enhance the fluid seal formed by the periphery of the mask with the wearer's face.

A significant technical advantage of the present invention includes a face mask having a filter body with fluid impervious flaps which cooperate with either tie strips or ear loops to allow the mask to conform to the contours of the face of a wearer. The filter body and the flaps block liquid spray and aerosols from contacting the portions of the wearer's face covered by the mask. The present invention allows optimizing the filtration capability of the mask for resistance to the passage of liquids and/or aerosols while allowing for a substantially improved fit between the periphery of the mask and the contours of a wearer's face.

Another significant technical advantage of the present invention includes a face mask having a filter body with fluid impervious flaps which allow reducing the surface area of the filter body, if desired, and thus the amount of filter media used to manufacture the mask while maintaining the same or an even greater amount of protective covering over the face of the wearer. The fluid impervious flaps allow reducing the amount of filter media used in construction of the mask, if desired, while maintaining the same high degree of breathability and high efficiency for removing particulate matter and/or aerosols.

BRIEF DESCRIPTION OF THE DRAWINGS

For a more complete understanding of the present invention and for further advantages thereof, reference is now made to the following description taken in conjunction with the accompanying drawings, in which.

DETAILED DESCRIPTION OF THE INVENTION

Figure 1:
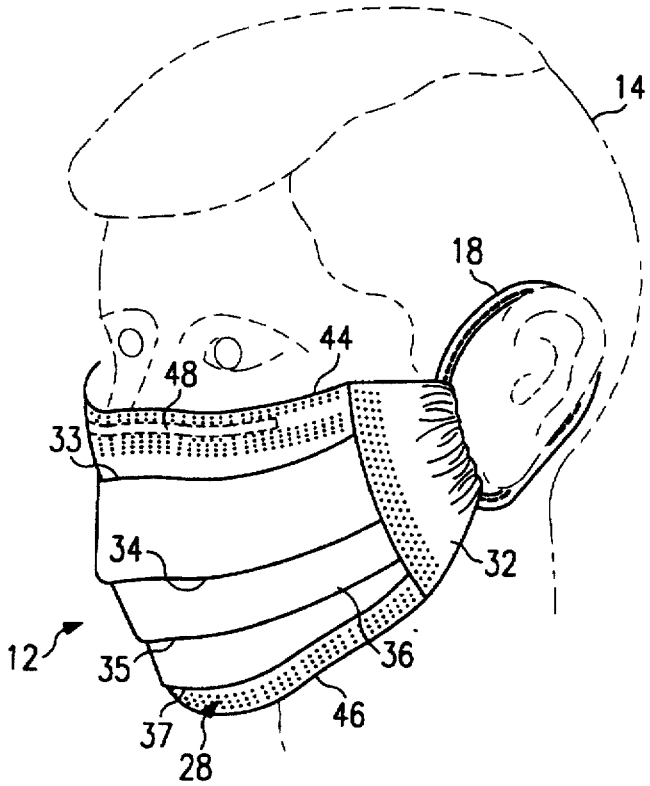
FIG. 1 is a perspective view of a face mask and filter body incorporating one embodiment of the present invention illustrated on the head of a wearer.

The preferred embodiments of the present invention and its advantages are best understood by referring to FIGS. 1–6B of the drawings, like numerals being used for like and corresponding parts of the various drawings.

Face mask 12 incorporating the present invention retards the flow of bacteria, liquids and aerosols from the exterior of mask 12 to the nose and mouth of wearer 14. For purposes of this application, aerosols are defined as insoluble liquids or particulate matter frequently associated within microbial solutions. The term "fluid" is used within this application to include any gas, liquid, or mixture of gas and liquid. Particulate matter and aerosols may be entrained with such fluids.

The present invention allows optimizing the fluid barrier formed between the periphery of mask 12 and the face of wearer 14 and the filtration capability of mask 12 to resist the passage of liquids, particulate matter and/or aerosols while at the same time minimizing resistance to normal breathing of wearer 14. The present invention allows using one layer or multiple layers of filter media which may be specifically designed to block the passage of aerosols in addition to liquids.

Fastening devices or securing means, such as ear loops 16 and 18, may be used to removably attach mask 12 to the head and face of wearer 14. Ear loops 16 and 18 are preferably secured to mask 12 by respective flaps 30 and 32. As will be explained later in more detail, various types of securing means may be used to attach a mask incorporating the present invention to the face of wearer 14. Surgical tie strips or surgical ties 116, 117, 118 and 119 shown in FIGS. 3–6B represent one example of these alternative securing means. Elastic ear loops, such as shown in U.S. Pat. No. 4,802,473 entitled *Face Mask with Ear Loops,* may be satisfactorily used with the present invention. U.S. Pat. No. 4,802,473 is incorporated by reference for all purposes within this application.

As best shown in FIGS. 1, 2A, 2B and 2C, mask 12 includes filter body 28 with flaps 30 and 32 extending respectively from each side of filter body 28. For some applications, filter body 28 may be fabricated in general as described in U.S. Pat. No. 4,635,628 entitled *Surgical Face Mask with Improved Moisture Barrier* and U.S. Pat. No. 4,969,457 entitled *Body Fluids Barrier Mask.* Both of these patents are incorporated by reference for all purposes within this application.

Flaps 30 and 32 may be formed from fluid impervious material folded with a generally U-shaped cross section. Flaps 30 and 32 may also sometimes be referred to as C-folds. For one application of the present invention, flaps 30 and 32 may be formed from polyethylene film laminated to any non-woven material. The non-woven material may also be hydro-entangled. For other applications, the polyethylene film may be laminated to any type of material as desired. The polyethylene film layer may be color coded to correspond with different applications for using the resulting face mask.

For other applications, a breathable type film may be used to form flaps 30 and 32. For still further applications, flaps 30 and 32 may be formed from resilient and/or stretchable materials. Such resilient materials include thermoplastic rubbers which may be extruded or injection molded as strips or sheets of material. An example of such thermoplastic rubbers is available under the trademark KRATON® from Shell Oil Company.

One of the benefits of the present invention is the ability to form flaps 30 and 32 from materials that have lower cost as compared to the material used to form filter body 28. Another benefit of the present invention is the ability to form flaps 30 and 32 from a wide variety of materials which provide an enhanced fluid seal with the face of the wearer while providing a comfortable fit during long periods of wear. Such materials are available from various suppliers.

Filter body 28 and flaps 30 and 32 are preferably designed to prevent or retard the passage of liquids from the exterior of mask 12 to the face of wearer 14. It is extremely difficult to construct a mask that will fit the facial configuration of all wearers without constructing the mask specifically for each individual face. The use of flaps 30 and 32 in combination with ear loops 16 and 18 greatly increases the different sizes and types of faces which can be effectively protected by mask 12. Forming ear loops 16 and 18 along with flaps 30 and 32 from suitable resilient or stretchable material further improves facial fit with a large number of wearers.

Filter body 28 comprises a plurality of pleats 33, 34, 35 and 37 which allow expansion of filter body 28 to cover the mouth and nose of wearer 14. The number of pleats 33, 34, 35 and 37 formed in filter body 28 may be varied to provide the desired fit with the face of wearer 14. Pleat 33 is preferably folded in a reverse direction as compared to pleats 34 and 35. By providing reverse pleat 33, filter body 28 has an increased tendency to stand away from the face of wearer 14. In embodiments containing pleat 37, pleats 35 and 37 are preferably folded in the same direction to create a double pleat. The use of double pleats 35 and 37 provides for a close fit of filter body 28 around the chin of wearer 14 and also extends the range of sizes for the associated mask. One embodiment of the present invention locates the reverse pleat 33 approximately 0.75 inches down from the top edge 44, spaces pleats 33 and 34 approximately 1.25 inches apart, spaces pleats 34 and 35 approximately 9/16 inches apart, and spaces pleats 35 and 37 approximately 5/16 inches apart.

For some applications filter body 28 may be formed without pleats. For other applications, filter body 28 may be formed with non-collapsing face panels such as shown in U.S. Pat. No. 4,606,341 entitled *Non-Collapsible Surgical Face Mask*. U.S. Pat. No. 4,606,341 is incorporated by reference for all purposes within this application. For still further applications, filter body 28 may be formed from only one layer of material or from multiple layers of material. Flaps 30 and 32 allow a wide variety of options in selecting material with the desired breathability and fluid resistance for filter body 28.

The use of reverse pleat 33 in cooperation with pleats 34, 35 and 37, if desired, forms a larger breathing chamber as compared to other soft, pleated style masks which contact a substantial portion of the wearer's face. The larger breathing chamber permits cooler and easier breathing associated with "off-the-face" style mask such as shown in U.S. Pat. No. 4,606,341. The present invention allows optimizing the volume of air contained within filter body 28 without sacrificing comfort to the wearer or filtration efficiency.

If the breathing chamber formed by filter body 28 is too large, excessive amounts of exhaled air may be retained within filter body 28 at normal breathing rates. By properly selecting the size of filter body 28 and the number of pleats 34, 35 and 37, along with flaps 30 and 32, excessive heating of air within filter body 28 is minimized and dizziness from prolonged periods of rebreathing exhaled air is also minimized. Since the present invention results in an enhanced fluid seal or barrier between the periphery of mask 12 and the face of wearer 14, incorporating the benefits of an "off-the-face" style face mask are important for extended periods of wearing mask 12.

Figure 2A:
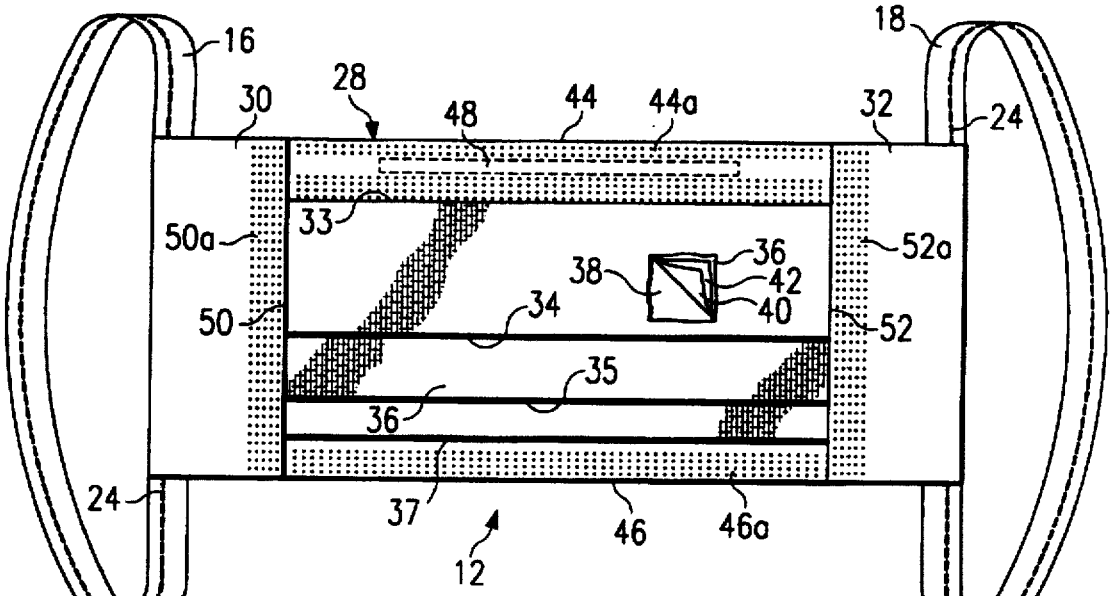
FIG. 2A is an elevational view of the front side or exterior of the mask of FIG. 1 with a cut-a-way showing multiple layers of material used to form the filter body of the mask.

As shown by the cutaway portion of FIG. 2A, filter body 28 includes four layers of material with an external surface of cover stock 36 as the outermost layer. Inner layer or internal surface 38 which contacts the face of wearer 14 may be constructed of a light weight, highly porous, softened, non-irritating, non-woven fabric, such as Dexter, Inc. product No. 3768. Inner layer 38 is designed to prevent unwanted materials such as facial hair, loose fibers or perspiration from contacting intermediate layers 40 and 42 which might cause a wicking effect to draw liquids through filter body 28. Inner layer 38 also provides a comfortable surface for contact with the face of wearer 14.

Intermediate layer 40 preferably comprises a barrier material that is capable of differentiating between gases and liquids and may be, for example, Visqueen Film Products' low density polyethylene, Vispore X-6212. Non-wetting materials, such as used to form barrier material 40, may have small apertures which prevent liquids with a relatively high surface tension from passing therethrough yet will allow gases with a low surface tension to pass therethrough. It is generally preferable to have the apertures as large as possible to allow easy breathing, and yet small enough to retard or prevent the flow of liquids. Intermediate layer 40 is designed to freely pass gases in either direction, while restricting the passage of liquids in at least on direction. Filter body 28 is preferably constructed with barrier material 40 positioned to restrict liquid passage from the exterior of mask 12. Further description of the construction and operation of such barrier material may be found in U.S. Pat. No. 3,929,135 issued Dec. 30, 1975, to Thompson, assigned to Proctor and Gamble Co., and is incorporated by reference for all purposes.

The next intermediate layer is preferably filtration media 42, which may be, for example, melt blown polypropylene or polyester. Filtration media 42 is provided to inhibit the passage of airborne bacteria in either direction which will prevent passage of germs to and from wearer 14. Outermost layer 36 provides the external surface for filter body 28, which may be treated, for example, by spraying with a liquid repellant to render the external surface of filter body 28 resistant to liquids.

Outer layer 36 and filtration media layer 42 serve as an aid to barrier material 40 by slowing down any liquid that may be splashed, sprayed or thrown at mask 12. By requiring the liquid to pass through layers 36 and 42 prior to reaching barrier material 40, the liquid will have less pressure and barrier material 40 will be better able to prevent passage of the liquid. Outer layer 36 may be formed from non-woven material such as cellulose fiber.

Filter body 28 may be formed by bonding layers 36, 38, 40, and 42 with each other in a generally rectangular configuration. Such bonding is preferably provided along top edge 44, bottom edge 46 and lateral sides 50 and 52, respectively. The corresponding bonded areas **44*a*, 52*a*, 46*a*, and 50*a*** may be formed by sewing, glue, heat sealing, welding, ultrasonic bonding and/or any other suitable bonding procedure.

Figure 2B:
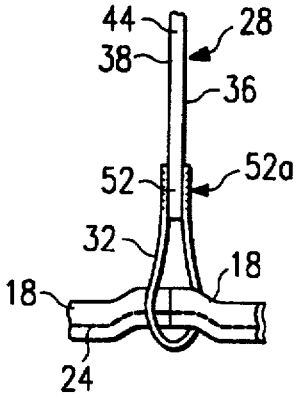
FIG. 2B is an end view with portions broken away showing one of the flaps and its respective ear loop associated with the face mask of FIG. 2A.

Flaps 30 and 32 are preferably integrally attached to filter body 28 as part of the respective bonded areas **50*a* and 52*a*. Flaps 30 and 32 are preferably formed from fluid impervious material such as a plastic membrane and folded with a U-shaped configuration to form an opening to receive ear loops 16 and 18 therein as shown in FIG. 2B. For some applications, bonded areas (not shown) may be used to secure ear loops 16 and 18 with corresponding mid-points of flaps 30 and 32. For other applications, flaps 30 and 32 may be formed with a J-shaped configuration (not shown) to receive ear loops 16 and 18 therein. Flaps 30 and 32 are shown having a generally rectangular configuration. For some applications, flaps 30 and 32 may be formed with a generally trapezoidal shape extending from the respective lateral sides 50 and 52 of filter body 28**.

Top edge 44 of filter body 28 preferably includes an elongated malleable member 48 provided so that top edge 44 of filter body 28 can be configured to closely fit the contours of the nose and cheeks of wearer 14. Malleable member 48 may be constructed from an aluminum strip with a rectangular cross section, but may also be a molded or malleable steel or plastic member. Top edge 44, bottom edge 46 and flaps 30 and 32 cooperate with each other to define the periphery of mask 12 which contacts the face of wearer 14. Flaps 30 and 32 substantially increase the area of contact with the face of wearer 14 as compared to a face mask having only lateral sides 50 and 52 in contact with the face of wearer 14.

Typically surgical style pleated face masks have a generally rectangular or square configuration of approximately seven inches by seven inches prior to pleating. The length and width dimensions of a typical face mask may vary by plus or minus one-half an inch (±½) resulting in a face mask which is often rectangular in configuration as compared to a square. For some applications, the present invention allows reducing the length of top edge 44 from seven inches to as short as four and one-half to five inches. Alternatively, the present invention allows increasing the length of top edge 44 as desired. Also, the distance from top edge 44 to bottom edge 46 when mask 12 has been placed over the face of wearer 14 may be reduced from seven inches to five and one-half to six inches. Therefore, flaps 30 and 32, along with other features of the present invention allow reducing the total area of the filter media associated with mask 12 from approximately forty-nine square inches to twenty-five square inches to thirty square inches while maintaining approximately the same effective area. This reduction in area results in a substantial savings in the cost of materials used to fabricate mask 12 while, at the same time, maintaining good breathability, high efficiency filtration, and providing an improved seal between the periphery of mask 12 and the face of wearer 14.

Ear loops 16 and 18 may be formed from various types of material. For one application of the present invention ear loops 16 and 18 are preferably formed from thermally bonded polypropylene having a basis weight of 1.5 to 1.65 ounces per square yard. This particular type of material can be ultrasonically welded, stitched or heat and pressure bonded in various patterns to provide a resilient securing means for use in attaching mask 12 to the face of wearer 14.

As shown in FIGS. 2A and 2B, a single sonic stitch 24 is provided along the length of each ear loops 16 and 18 to provide the desired longitudinal stretch and recovery capability. Single sonic stitch pattern 24 allows most of the material used to form ear loops 16 and 18 to be open and free from the associated bonded area. Stitch pattern 24 allows ear loops 16 and 18 to retain their naturally resilient characteristics.

Various other types of resilient material may be satisfactorily used to form ear loops 16 and 18. By providing resilient ear loops 16 and 18, the periphery of face mask 12 will maintain a tight fluid barrier with the face of wearer 14 over a relatively long period of time. Talking and other activities by wearer 14 will not compromise the integrity of the resulting fluid barrier.

Ear loops 16 and 18 may be positioned on each ear of wearer 14 as shown in FIG. 1. Positioning ear loops 16 and 18 in this manner results in compressing or gathering the respective flaps 30 and 32 to form a flat, flanged type fluid barrier with the face of wearer 14. Also, ear loops 16 and 18 in cooperation with their respective flaps 30 and 32 urge top edge 44 and bottom edge 46 into fluid sealing engagement with the contours of the face of wearer 14. The size and resiliency associated with each ear loop 16 and 18 may be varied to provide the optimum amount of force to form the desired fluid barrier between the periphery of mask 12 and the face of wearer 14.

Figure 2C:
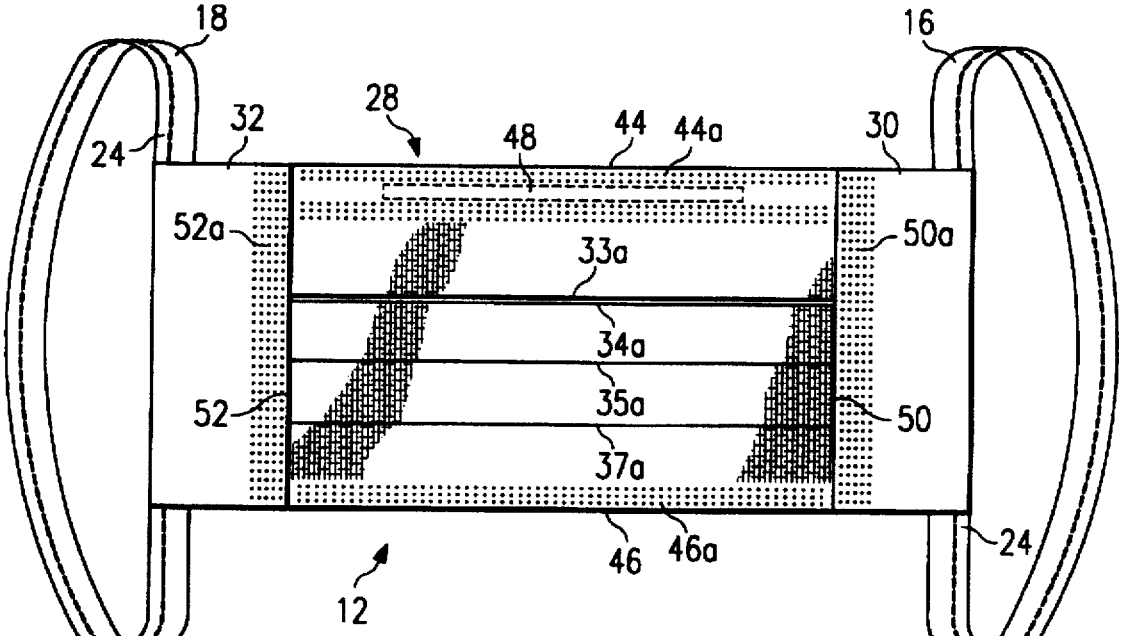
FIG. 2C is an elevational view of the back side or interior of the mask of FIG. 1.

As shown in FIG. 2C, the back side or interior of filter body 28 comprises a plurality of pleats **33*a*, 34*a*, 35*a* and 37*a* which allow expansion of filter body 28 to cover the mouth, nose and chin of wearer 14. The number of pleats 34*a*, 35*a* and 37*a* formed on the back side of filter body 28 may be varied to accommodate a wide range of sizes while still providing the desired fit with the face of wearer 14**.

Figure 3:
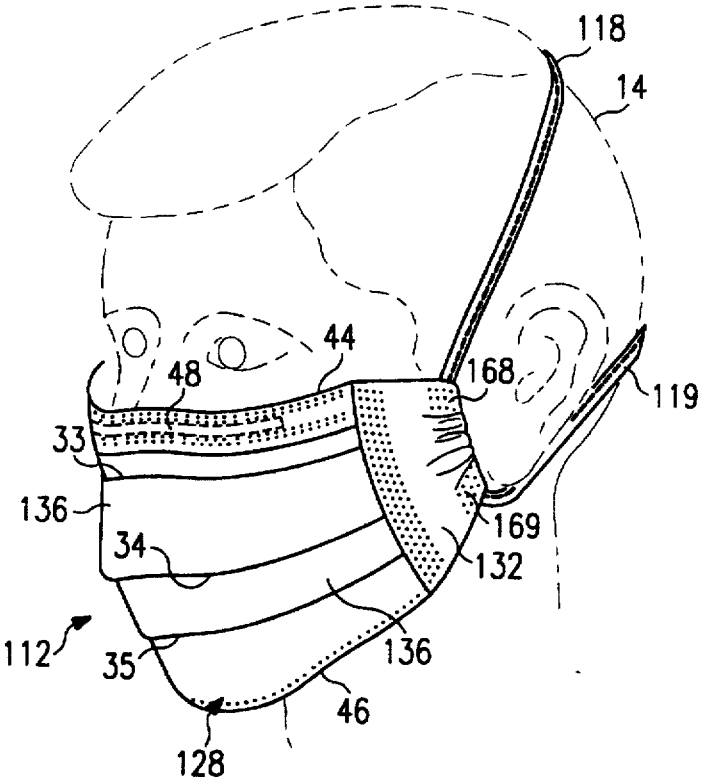
FIG. 3 is a perspective view of a face mask and filter body incorporating another embodiment of the present invention illustrated on the head of a wearer.
Figure 4B:
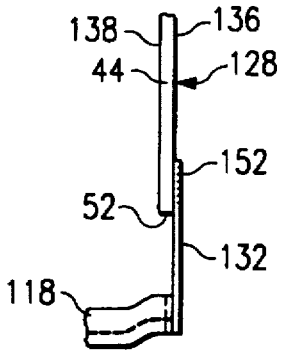
FIG. 4B is an end view with portions broken away showing one of the flaps and its respective surgical tie associated with the face mask of FIG. 4A.
Figure 4A:
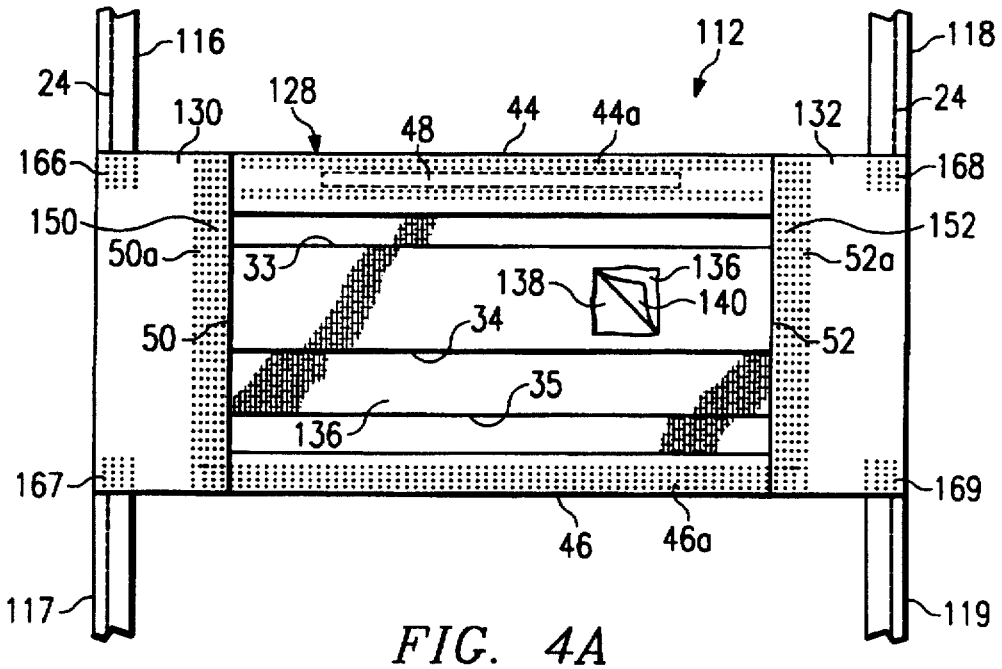
FIG. 4A is an elevational view with portions broken away of the mask of FIG. 3 with a cut-a-way showing multiple layers of material which form the filter body of the mask.

An alternative embodiment of the present invention is represented by mask 112 shown in FIGS. 3, 4A and 4B. Some of the differences between masks 12 and 112 include forming filter body 128 from different layers of material as compared with filter body 28, forming each flap 130 and 132 as a single, flat sheet of material extending from respective lateral sides 50 and 52 of filter body 128 and replacing ear loops 16 and 18 with surgical ties 116, 117, 118 and 119. Flaps 130 and 132 are each formed from a sheet of generally rectangularly shaped material. For some applications, flaps 130 and 132 may be formed from a sheet of generally trapezoidal-shaped material.

For the embodiment of the present invention shown in FIGS. 4A and 4B, only edge 150 of flap 130 is bonded with lateral side 50 of filter body 128. In the same manner, only edge 152 of flap 132 is bonded with lateral side 52 of filter body 128. The respective bonded areas **50*a* and 52*a* between flaps 130 and 132 and filter body 128 may be formed by various techniques as previously described with respect to mask 12**.

As shown in FIG. 4A, first surgical tie 116 may be attached to the upper portion of flap 130 with one end of surgical tie 116 bonded at area 166 to flap 130 extending from top edge 44 of filter body 128. Second surgical tie 117 is attached to the lower portion of flap 130 with one end of surgical tie 117 bonded at area 167 to flap 130 extending from bottom edge 46 of filter body 128. In a similar manner, third surgical tie 118 is attached to flap 132 at bonded area 168 and fourth surgical tie 119 is attached to flap 132 at bonded area 169.

The arrangement of surgical ties 116 and 117 on flap 130 and surgical ties 118 and 119 on flap 132 is such that surgical ties 116 and 118 may be placed over the top of the head of wearer 14. Surgical ties 117 and 119 may be positioned around the lower base of the head of wearer 14. Positioning surgical ties 116, 117, 118 and 119 in this manner results in compressing or gathering the respective flaps 130 and 132 to form a flat, flanged type fluid barrier with the face of wearer 14. Also, securing surgical ties 117 with surgical tie 118 and surgical tie 116 with surgical tie 119 in this manner urges top edge 44 and bottom edge 46 into fluid sealing engagement with the contours of face of wearer 14.

The use of surgical ties 116, 117, 118 and 119 allows wearer 14 to vary the position of the surgical ties with respect to wearer 14 to provide the optimum angle of pull and the optimum amount of force to form the desired fluid barrier between the periphery of mask 112 and the face of wearer 14. For some application, surgical ties 116 and 117 may be replaced by a single surgical tie (not shown). In the same manner, surgical ties 118 and 119 may be replaced by a single surgical tie (not shown). Surgical ties 116, 117, 118 and 119 may be formed from various types of resilient and/or non-resilient material depending upon the intended use for the resulting face mask. One embodiment of the present invention provides a length of 33 in. between the tips of ties 116 and 117 and the tips of ties 118 and 119, respectively. For other applications, surgical ties 116, 117, 118 and 119 may be replaced with a pair of ear loops secured respectively to each flap 130 and 132.

As illustrated in FIG. 4A, filter body 128 includes an outer mask layer 136 that is preferably constructed from a spun-bonded polypropylene. Outer mask layer 136 may also be constructed from a bi-component and/or powder bonded material such as polyethylene or polypropylene, a cellulastic tissue, or a spun-bonded polyester. Outer mask layer 136 will typically have a basis weight range of 0.5 ounces per yard of 1.0 ounces per yard. 0.7 ounces per yard is one of the preferred basis weights for outer layers 136.

Inner mask layer 138 is preferably composed of bicomponent polyethylene and polypropylene or bicomponent polyethylene and polyester. Layer 138 may also be constructed from polyester and/or polyethylene material or cellulastic tissue. Layer 138 will typically have a basis weight range of 0.4 ounce per yard to 0.75 ounces per yard. 0.413 ounces per yard is one of the preferred basis weights for layer 138. One or more intermediate layers of filter media may be disposed between outer mask layer 136 and inner mask layer 138. Selection of the number and type of intermediate layers of filter media will depend upon the intended use and function for mask 112. In FIG. 4A, filter body 128 is shown with only one intermediate mask layer 140 which comprises the filter media for mask 112. This layer is preferably constructed from a melt-blown polypropylene, but may be constructed from an extruded polycarbonate, a melt-blown polyester, or a melt-blown urethane.

Figure 5:
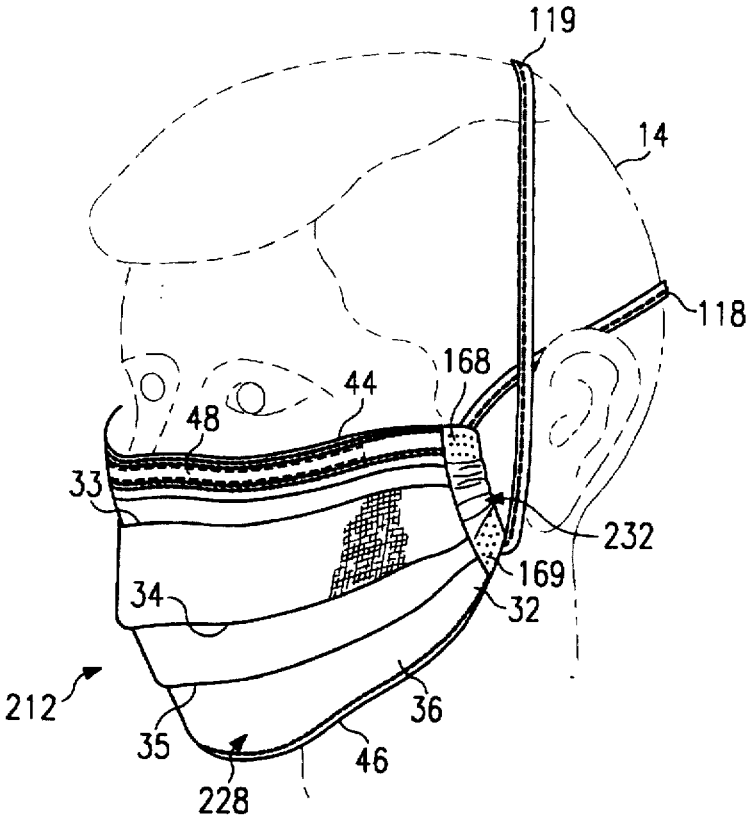
FIG. 5 is a perspective view of a face mask and filter body incorporating a further embodiment of the present invention illustrated on the head of a wearer.
Figure 6B:
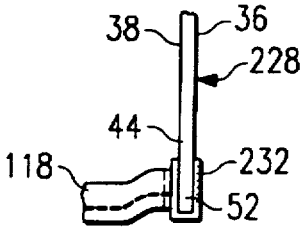
FIG. 6B is an end view with portions broken away showing a strip of resilient material forming a binding along one side of the face mask of FIG. 6A and its respective surgical tie.
Figure 6A:
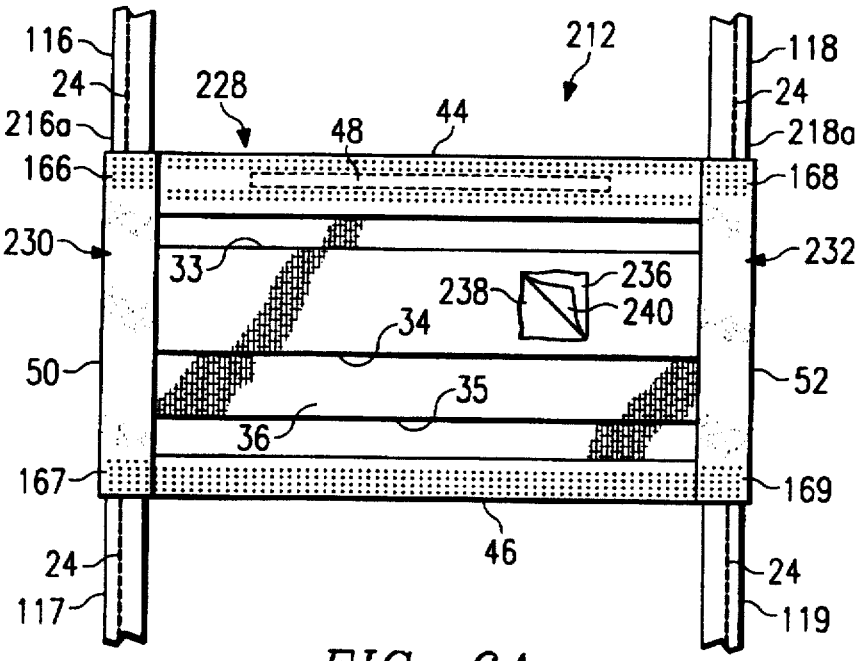
FIG. 6A is an elevational view with portions broken away of the mask of FIG. 5 with a cut-a-way showing multiple layers of material which form the filter body of the mask.

Another alternative embodiment of the present invention is represented by mask 212 as shown in FIGS. 5, 6A and 6B. Mask 212 includes filter body 228 which may be secured to wearer 14 by surgical ties 116, 117, 118 and 119. An important benefit of the present invention includes the ability to select various types of material to form the filter body associated with each mask 12, 112, and 212.

For the embodiment of the present invention shown in FIGS. 6A and 6B, filter body 228 includes intermediate layer 240 of filter media disposed between layers 236 and 238. For this particular embodiment, inner and outer mask layers 238 and 236 respectively are formed from the same type of material. However, various types of material may be used with intermediate mask layer 240. For the embodiment of FIG. 6A, intermediate mask layer 240 may be formed from expanded polytetrafluoroethylene (PTFE) membrane. Such materials are manufactured by W. L. Gore & Associates. A more complete description of the construction and operation of such materials can be found in U.S. Pat. No. 3,953,566 entitled *Process for Producing Porous Products*, issued on Apr. 27, 1976 to Robert W. Gore, and U.S. Pat. No. 4,187,390 entitled *Porous Products for Process Therefor*, issued on Feb. 5, 1980 to Richard W. Gore. These patents are incorporated by reference for all purposes within this application. For some applications and operating environments the use of filter media 240 substantially enhances the performance of mask 212 in an aerosol environment.

As shown in FIGS. 6A and 6B, strips of resilient material 230 and 232 may be attached to respective lateral sides 50 and 52 of filter body 228. Strips of resilient material 230 and 232 preferably extend between top edge 44 and bottom edge 46 along the respective lateral sides 50 and 52. Various types of adhesives, ultrasonic seals, heat seals and/or other bonding techniques may be used to attach strips of resilient material 230 and 232 with filter body 28.

For one application, strips of resilient material 230 and 232 are preferably formed from fluid impervious, elastomeric material. Resilient strips of material 230 and 232 preferably have a generally U-shaped cross section which fits snugly with the respective lateral sides 50 and 52 of filter body 228 as shown in FIG. 6B. For some applications, a strip of resilient material may be placed only on the exterior surface of filter body 228 extending between top edge 44 and bottom edge 46. Forming resilient strips of material 230 and 232 with a generally U-shaped cross section substantially increases the area of contact with the face of wearer 14 as compared to a face mask having only lateral sides 50 and 52 in contact the face of wearer 14.

Surgical ties 116, 117, 118 and 119 may be attached to filter body 228 using bonded areas 166, 167, 168 and 169. If desired, surgical ties 116, 117, 118 and 119 may be placed on the head of wearer 14 as previously described with respect to mask 112. Surgical ties 116, 117, 118 and 119 in cooperating with resilient strips 230 and 232 allow positioning filter body 228 to form a fluid-tight barrier or seal between the periphery of mask 212 and the face of wearer 14.

As previously noted, surgical ties 116 and 118 extend from top edge 44. In a similar manner, surgical ties 117 and 119 extend from bottom edge 46. For some applications, it may be desirable to cross surgical tie 117 over surgical tie 116 (not shown) and surgical tie 119 over surgical 118 as shown in FIG. 5. The respective surgical ties 117 and 119 may then be tied with each other over the top of head of wearer 14. The respective surgical ties 116 and 118 may be tied with each other generally about the back of the head of wearer 114. This configuration results in surgical ties 117 and 119 cooperating with each other to urge bottom edge 46 of face mask 212 into tight engagement below the chin of wearer 14. In the same manner, surgical ties 116 and 118 cooperate with each other to extend in a generally linear continuation from top edge 44 and to urge top edge 44 tight engagement with the face of wearer 14. Crossing the respective surgical ties 116, 117, 118 and 119 results in additional compression of the respective resilient strips 230 and 232 which further enhances the fluid seal formed between the periphery of mask 212 and adjacent portions of the face of wearer 14. The present invention allows positioning surgical ties 116, 117, 118 and 119 to provide the optimum full angle and the optimum amount of force to form the desired fluid barrier between the periphery of mask 12 and the face of wearer 14.

Various types of face shields and/or visors may be combined with face mask 12, 112 and 212. U.S. Pat. No. 5,020,533 entitled *Face Mask with Liquid and Glare Resistant Visor* describes the benefits of combining a visor and a darkened strip of material with a face mask. U.S. Pat. No. 5,020,533 is incorporated by reference for all purposes within this application. If desired, a darkened strip of material (not shown) may be placed along top edge 44 of filter bodies 28, 128 and/or 228 to reduce glare when a visor is attached to the respective filter body.

The present invention allows designing mask 12, 112 and 212 with the optimum periphery to fit the face of wearer 14 and the optimum dimensions for malleable strip 48 to form an enhanced fluid barrier with the nose and face of wearer 14. The present invention also allows modification to the length of top edge 44 and bottom edge 46 while maintaining the required surface area for efficient filtration and normal breathing through filter media 240.

The use of barrier materials which block the passage of liquids is particularly important when masks 12, 112 and 212 are worn with a visor (not shown) in an environment where wearer 14 may be exposed to "body fluids." These fluids such as blood, urine and saliva may contain highly contagious germs and viruses. Contact of AIDS-contaminated body fluids with another person's source of body fluids, such as the eyes, nose and mouth, may transmit the disease. Therefore, it is often preferable to include layer 40 and/or 240 which are resistant to the passage of liquids through the associates filter body 28 and 228 to prevent body fluids from contacting the nose and mouth of wearer 14. U.S. Pat. Nos. 4,920,960 and 5,020,533 provide additional information on materials which may be used for layers 36, 38, 40, 42, 136, 138, 140, 236, 238 and 240 and face masks constructed with such materials. Other types of liquid barriers may be satisfactorily used with the present invention.

Although the present invention has been described in detail with respect to alternative embodiments, various changes and modifications may be suggested to one skilled in the art, and it should be understood that various changes, substitutions, and alterations can be made hereto without departing from the spirit and scope of the invention as defined by the appended claims.

What is claimed is:

1. A surgical style face mask comprising:

a non-molded, flexible filter body sized to fit over the mouth and nose of a wearer, the filter body having top and bottom edges with the top edge arranged to extend across the nose and cheeks of the wearer and the bottom edge arranged to extend under the chin of the wearer;

an elongated malleable member disposed adjacent to the top edge to allow configuring the top edge to closely fit the contours of the nose and cheeks of the wearer;

the filter body having a pair of lateral edges extending between the top edge and the bottom edge;

a flap attached to each lateral edge of the filter body and arranged to extend from the filter body;

the flaps formed from fluid impervious, flexible material that is different from the material used to form the filter body;

a first ear loop attached to one of the flaps with the first ear loop spaced from the respective lateral edge of the filter body and a second ear loop attached to the other flap with the second ear loop spaced from the respective lateral edge of the filter body;

the first ear loop and the second ear loop arranged to extend from the respective flaps and over one of the ears of the wearer, the first ear loop and the second ear loop cooperating with the respective flaps for urging the top edge and the bottom edge of the filter body into engagement with the face of the wearer to prevent undesired fluid flow between the top edge and the bottom edge and the wearer's face;

the first ear loop and the second ear loop providing means for gathering the respective flaps into sealing contact with the wearer's face to prevent undesired fluid flow between the respective lateral edges of the filter body and adjacent portions of the face of the wearer; and the first ear loop and the second ear loop and the respective flaps cooperating with each other to increase the number of different sizes and types of faces which may be effectively protected by the associated face mask.

2. The mask of claim 1 further comprising the filter body having multiple pleats and a generally rectangular configuration.

3. The mask of claim 1 wherein the filter body further comprises multiple layers of material with an intermediate layer of material which is gas permeable in both directions through the filter body and substantially liquid impermeable in the direction from outside the filter body to inside the filter body.

4. The mask of claim 1 further comprising:

each ear loop formed from resilient material to improve facial fit between the associated mask and the face of the wearer; and the size and resiliency of each ear loop varied to provide the optimum amount of force to form the desired fluid barrier between the top edge, bottom edge and lateral edges of the filter body and adjacent portions of the face of the wearer.

5. The mask of claim 1 further comprising:

each flap formed with a generally C-fold section attached to the respective lateral edge of the filter body; and each ear loop secured within the C-fold section of its respective flap to allow each ear loop to compress its respective flap.

6. The mask of claim 1 further comprising the flaps formed at least in part from thermoplastic rubber material.

7. The mask of claim 1 further comprising the flaps formed in part from foam material.

8. The mask of claim 1 wherein said filter body further comprises a first layer of bicomponent material disposed on one side of an intermediate layer of expanded polytetrafluoroethylene and a second layer of the same bicomponent material disposed on the opposite side of the layer of expanded polytetrafluoroethylene.

9. The mask of claim 1 further comprising:

each flap formed by folding the flexible material to define a generally U-shaped folded section attached to the respective lateral edge of the filter body;

a portion of the first ear loop formed from resilient material and secured within the U-shaped folded section of its respective flap; and a portion of the second ear loop formed from resilient material and secured within the U-shaped folded section of its respective flap.

10. The mask of claim 9 further comprising:

the first ear loop bonded to its respective flap at a location proximate the midpoint of the associated U-shaped folded section to allow compressing the respective flap by the first ear loop; and the second ear loop bonded to its respective flap at a location proximate the midpoint of the associated U-shaped folded section to allow compressing the respective flap by the second ear loop.

11. The mask of claim 1 wherein the filter body further comprises a plurality of pleats extending from one lateral edge to the other lateral edge, the pleat nearest to the top edge being reversed relative to the remaining pleats such that the filter body has an increased tendency to stand away from the wearer.

12. The mask of claim 11 wherein the reverse pleat is located approximately ¾ of an inch from the top edge of the filter body.

13. The mask of claim 1 wherein the filter body further comprises a plurality of pleats, the pleats nearest the bottom edge being at least two in number such as to provide a close fit of the filter body around the chin of the wearer and provide greater sizing capability for the mask.

14. A surgical style face mask comprising:

a non-molded, flexible filter body having a generally rectangular configuration and sized to fit over the mouth and nose of a wearer, the filter body having top and bottom edges with the top edge arranged to extend across the nose and cheeks of the wearer and the bottom edge arranged to extend under the chin of the wearer;

an elongated malleable member disposed adjacent to the top edge to allow configuring the top edge to closely fit the contours of the nose and cheeks of the wearer;

the filter body having a pair of lateral edges extending between the top edge and the bottom edge;

a flap attached to each lateral edge of the filter body and arranged to extend from the filter body with only one edge of each flap attached to the respective lateral edge of the filter body;

each flap formed from a generally flexible material;

a first surgical tie and a second surgical tie attached to one of the flaps by respective bonded areas spaced from the respective lateral edge of the filter body;

a third surgical tie and a fourth surgical tie attached to the other flap by respective bonded areas spaced from the respective lateral edge of the filter body;

the surgical ties and their respective flaps arranged to allow the surgical ties to extend generally about the head of the wearer;

the first surgical tie and the second surgical tie cooperating with their respective flap along with the third surgical tie and the fourth surgical tie cooperating with their respective flap for urging the top edge and the bottom edge of the filter body into engagement with the face of the wearer to prevent undesired fluid flow between the top edge and the bottom edge and the wearer's face; and the first surgical tie and the second surgical tie providing means for gathering and compressing the one flap and the third surgical tie and the fourth surgical tie providing means for gathering and compressing the other flap to prevent undesired fluid flow between the respective lateral sides of the filter body and the face of the wearer.

15. The mask of claim 14 further comprising the flaps in part formed from polyethylene film.

16. The mask of claim 14 further comprising the flaps formed from a material different from the material used to form the filter body.

17. The mask of claim 14 wherein the surgical ties further comprise resilient material.

18. The mask of claim 14 further comprising:

each flap having an upper portion and a lower portion extending from the filter body;

the first surgical tie attached to the upper portion of the one flap with one end of the first surgical tie bonded with the upper portion of the one flap extending from the top edge of the filter body;

the second surgical tie attached to the lower portion of the one flap with one end of the second surgical tie bonded to the lower portion of the one flap extending from the bottom edge of the filter body;

the third surgical tie attached to the upper portion of the other flap with one end of the third surgical tie bonded to the upper portion of the other flap extending from the top edge of the filter body; and the fourth surgical tie attached to the lower portion of the other flap with one end of the fourth surgical tie bonded to the lower portion of the other flap extending from the bottom edge of the filter body.

19. A surgical style face mask comprising:

a non-molded, flexible filter body sized to fit over the mouth and nose of a wearer, the filter body having top and bottom edges with the top edge arranged to extend across the nose and cheeks of the wearer and the bottom edge arranged to extend under the chin of the wearer;

the filter body having multiple pleats and a generally rectangular configuration with an elongated malleable member located in the top edge for conforming the top edge to the contours of the wearer's nose and cheeks;

the top edge of the filter body having a first end and a second end;

the bottom edge of the filter body having a first end spaced laterally from the first end of the top edge and a second end spaced laterally from the second end of the top edge;

a first lateral edge extending between the first end of the top edge and the first end of the bottom edge;

a second lateral edge extending between the second end of the top edge and the second end of the bottom edge;

a first sheet of flexible material attached to and extending from the first lateral edge of the filter body with only one lateral edge of said first sheet attached to said first lateral edge of said filter body;

a second sheet of flexible material attached and extending from the second lateral edge of the filter body with only one lateral edge of said second sheet attached to said second lateral edge of said filter body;

means for respectively gathering each sheet of flexible material extending from the first and second lateral edges into sealing contact with adjacent portions of the wearer's face comprising first securing means and second securing means attached respectively to only the free lateral edges of the first sheet and the second sheet of flexible material;

the first sheet of flexible material connecting the first securing means with the filter body and the second sheet of flexible material connecting the second securing means with the filter body; and the first securing means and the second securing means arranged to extend generally about the head of the wearer, the first and second securing means attached respectively to the first sheet and the second sheet of flexible material for urging the top edge and the bottom edge into engagement with the face of the wearer and for gathering the first and the second sheets of flexible material to prevent undesired fluid flow between the top edge, the bottom edge and between the respective lateral edges of the filter body and adjacent portions of the face of the wearer.

20. The mask of claim 19 further comprising each sheet of flexible material selected from the group consisting of polyethylene film laminated with a non-woven material, a breathable film, extruded thermal plastic rubber compounds and injection molded thermal plastic rubber compounds.

21. The mask of claim 19 further comprising each sheet of flexible material having a generally trapezoidal configuration.

22. The mask of claim 19 further comprising each sheet of flexible material having a generally rectangular configuration.

* * * * *